US006080056A

United States Patent [19]

Karlsson

[11] Patent Number: 6,080,056

[45] Date of Patent: Jun. 27, 2000

[54] COIN HANDLING APPARATUS AND A COIN DEPOSIT MACHINE INCORPORATING SUCH AN APPARATUS

[75] Inventor: Jerry Karlsson, Malmö, Sweden

[73] Assignee: Scan Coin Industries AB, Malmo, Sweden

[21] Appl. No.: 09/219,025

[22] Filed: Dec. 22, 1998

[30] Foreign Application Priority Data

Dec. 22, 1997 [SE] Sweden ..... 970485

[51] Int. Cl.[7] ..... G07D 3/00; G07D 1/00

[52] U.S. Cl. ..... 453/3; 453/49

[58] Field of Search ..... 453/3, 4, 6, 10, 453/12, 49, 57; 221/277

[56] References Cited

U.S. PATENT DOCUMENTS 4,172,462 10/1979 Uchida et al. ..... 453/6
5,624,308 4/1997 Rumbach ..... 453/3
5,984,711 11/1999 Abe ..... 453/57

FOREIGN PATENT DOCUMENTS 257175 11/1969 U.S.S.R. ..... 453/3
92/18950 10/1992 WIPO ..... 453/57

*Primary Examiner*—Robert P. Olszewski
*Assistant Examiner*—Bryan Jaketic
*Attorney, Agent, or Firm*—James Ray & Associates

[57] ABSTRACT

A coin handling apparatus for sorting and/or counting a plurality of coins (15*a–h*) has a circular sorting path with at least one off-sort station (6) and a rotatable carrier device (3) for transporting the coins along the circular sorting path. Furthermore, the apparatus has a first rotatable means (1) with a first surface and a second rotatable means (3) with a second surface. The first and second surfaces are arranged to rotate at essentially the same speed and to engage the coins (15*a–h*) therebetween, thereby transporting the coins along the circular sorting path.

33 Claims, 6 Drawing Sheets

COIN HANDLING APPARATUS AND A COIN DEPOSIT MACHINE INCORPORATING SUCH AN APPARATUS

TECHNICAL FIELD

The present invention relates to a coin handling apparatus for sorting and/or counting a plurality of coins, the apparatus comprising a circular sorting path with at least one off-sort station, and a rotatable carrier device for carrying the coins along the circular sorting path.

The invention also relates to a coin deposit machine incorporating such a coin handling apparatus.

DESCRIPTION OF THE PRIOR ART

Coin sorters of the aforesaid type are well-known in the technical field and have been widely used for a long time. For instance, U.S. Pat. No. 5,295,899 discloses a coin sorter including a rotating hard disk forming the bottom of a coin feeding device (also known as hopper), and a stationary sorter plate arranged at one side of the hard disk. The sorter plate includes a circular sorting path, which begins at a point adjacent to the periphery of the hard disk and which includes a series of spaced sorting openings, each of which is sized for a particular coin denomination. The path has an edge defined by a thin resilient rail held in place in a groove by an elastomer band. A second rotating disk acting as a coin carrier device is provided with a series of resilient fingers protruding from the underside of the disk and is mounted above and in close proximity to the upper surface of the sorter plate. The fingers partially overlap the upper surface of the hard disk. Coins deposited in the coin feeding device (hopper) are formed into a single file and single layer at the outer edge of a central upright portion of the hard disk. The single file of coins is carried by the flexible fingers from the hard disk of the coin feeding device to the sorting path, where the coins are sorted by size and counted, as they pass through the sorting openings.

Similar coin sorters are disclosed in e.g. WO97/25692, DE-C2-28 29 285, DE-A1-196 03 876 and U.S. Pat. No. 5,624,308.

Several disadvantages and insufficiencies have been experienced with coin sorters of the type described above. For instance, since the coin sorter is of a passive type with a plurality of circularly arranged coin sorting openings of increasing size (i.e. the coins with the smallest diameter are sorted off through the smallest opening, the coins with the second smallest diameter are sorted off through the next sorting opening, etc), the sorter plate will have to be carefully designed to match all denominations in the coin system for which the coin sorter is to be used. To be able to use the coin sorter for a different coin system, for instance in a different country, the sorter plate will have to be redesigned.

Furthermore, since the coins are carried by the rotating carrier device across the stationary sorter plate at a relatively high speed, there is a considerable amount of friction between the bottom surfaces of the coins and the upper surface of the sorter plate. The frictional forces thus generated cause considerable machine wear in the long-time perspective and may accidentally damage some of the coins. Additionally, the coin sorter will consume a high amount of power for driving the carrier device at a high speed across the stationary sorter disk.

A particularly pronounced problem with coin sorters of the aforesaid type is the galling of aluminum coins, i.e. fine aluminium particles are rubbed off the coins and are "welded" to the sorter plate due to the substantive heat generated by the friction.

A further drawback of such coin sorters is a large overall machine size due to the horizontal arrangement of the coin feeding device next to the coin sorter.

SUMMARY OF THE INVENTION

It is an object of the present invention to provide a coin handling apparatus, where the problems described above are eliminated or at least considerably reduced.

The object is achieved by a coin handling apparatus for sorting and/or counting a plurality of coins, the apparatus comprising a circular sorting path with at least one off-sort station and a rotatable carrier device for carrying the coins along the circular sorting path, the apparatus further comprising a first rotatable means with a first surface and a second rotatable means with a second surface, the first and second surfaces being arranged to rotate at essentially the same speed and being arranged to engage the coins therebetween, thereby transporting the coins essentially frictionless along the circular sorting path.

Further objects, advantages and features of the present invention appear from the accompanying drawings, the appended dependent patent claims and the detailed disclosure of preferred and alternative embodiments of the invention.

BRIEF DESCRIPTION OF THE DRAWINGS

Preferred and alternative embodiments of the present invention will now be described in more detail, reference being made to the accompanying drawings, in which.

DETAILED DISCLOSURE OF THE INVENTION

Figure 1:
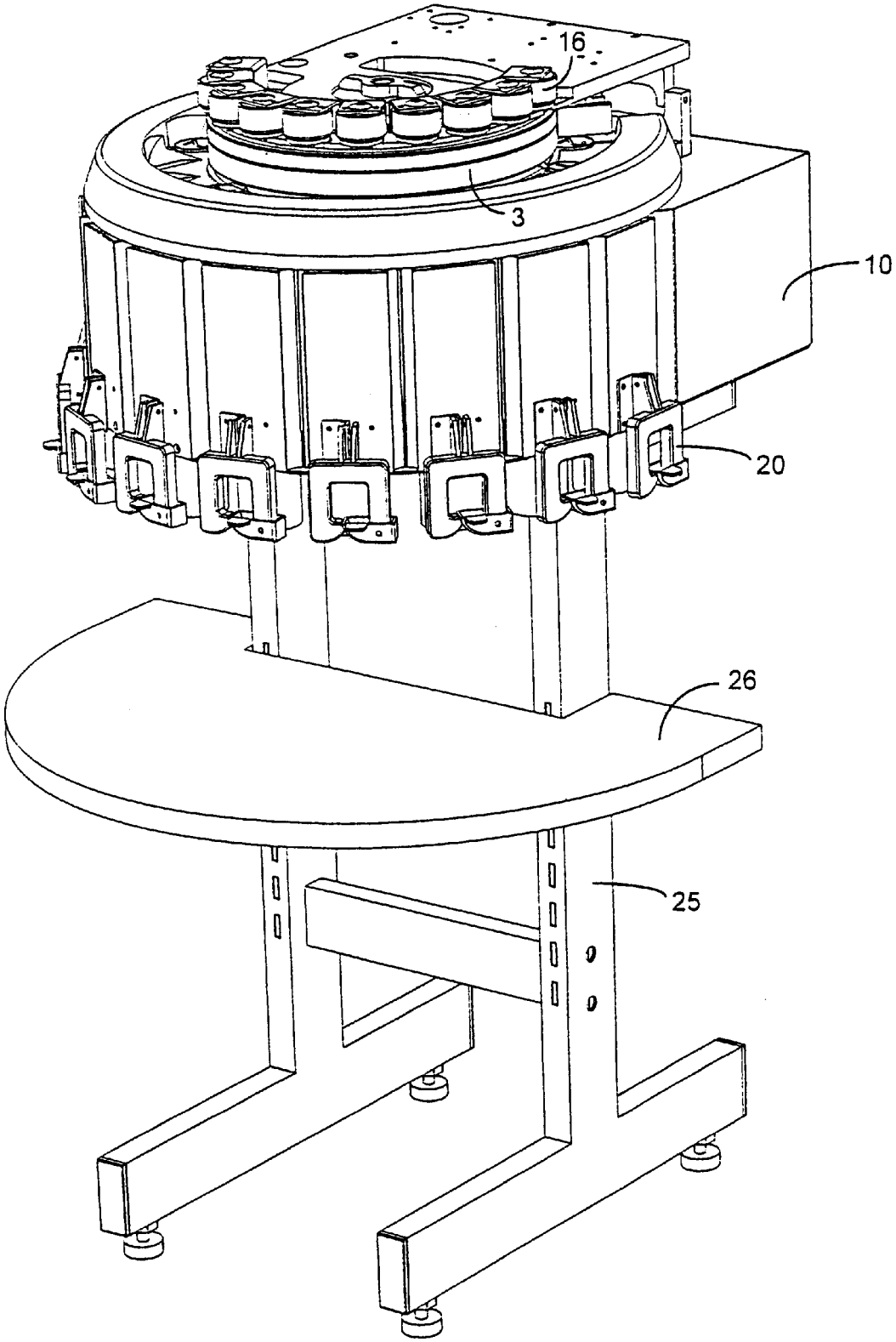
FIG. 1 is a perspective view of a coin handling apparatus according to the preferred embodiment, mounted on a stand.

As shown in FIG. 1, the coin handling apparatus of the present invention may advantageously be mounted on a stand 25 with a bag support shelf 26, thereby forming a stand-alone machine together with a top cover not shown in the drawing.

In FIGS. 2–6 the coin handling apparatus according to the preferred embodiment of the present invention is illustrated during the processing (i.e. counting and sorting) of a plurality of coins, which are generally represented by the reference numeral 15. Coins at specific positions in the coin handling apparatus are labelled 15*a,* 15*b,* etc., as will be described below.

As appears from FIGS. 1–3, the coin handling apparatus comprises an apparatus frame 10, a plurality of coin chutes 18, 19 and corresponding coin bag attachments 20, which are all circularly arranged around the central components of the apparatus, as described below. The bag attachments 20 are provided with coin bags (not shown) for receiving and storing coins, that have been processed by the apparatus. The lower ends of the coin bags are supported by the shelf 26.

An essentially flat rotating disk 1 is mounted in its center point to an axle 11. A stationary ring 2 is arranged above the rotating disk 1 and is preferably made from steel, aluminum or plastics. The stationary ring 2 does not reach contact with the rotating disk 1 but is arranged immediately above the latter with only a minimum gap between them. On the outside of the stationary ring 2 a rotating ring 3 is mounted by means of three bearings 5 equiangularly located at the circumference of the rotating ring 3. On the underside thereof the rotating ring 3 is provided with an resilient strip or rim 14, as appears particularly from FIG. 4. The resilient rim 14 is advantageously made from an elastomer material. The rotating ring 3 is biased towards the rotating disk 1 by the mounting of bearings 5, so that the resilient rim 14 frictionally engages the upper surface of the rotating disk 1, thereby forcing the periphery of the rotating disk 1 to rotate at the same speed as the rotating ring 3, when the latter is driven by means of an electric motor 12 and a drive belt 13.

The rotating disk 1 is arranged to receive an unsorted plurality of coins 15 from e.g. a human user or a coin supply device not disclosed herein. For reasons of clarity, only a few coins 15, 15*a* . . . 15*h* have been indicated in the drawings. In reality, the number of coins is considerably larger. As the disk 1 is rotated in a direction indicated by an arrow 22 in FIG. 2, the coins deposited onto the disk are accelerated by the centrifugal force in the radial direction of the disk towards the stationary ring 2, as indicated by 15*a* in FIG. 2. The plurality of coins are driven through an opening 23 in the stationary ring 2 and are forced into contact with the inside of the resilient rim 14 on the rotating ring 3 (see 15*b*). A thin stationary edge or knife 4 is mounted on the underside of the stationary ring 2 with a minimum gap to the upper surface of the rotating disk 1. As appears from FIG. 2, the stationary edge 4 has a curved shape, which starts tangentially from the outside wall of the stationary ring 2 and extends elliptically along a short, curved path towards the centerpoint of the disk 1. The stationary edge 4 ends at a point, which is located far enough from the periphery of the rotating ring 3 (i.e. the resilient rim 14) for allowing also coins of the largest possible diameter to be peeled off by the stationary edge 4, as described below.

Figure 4:
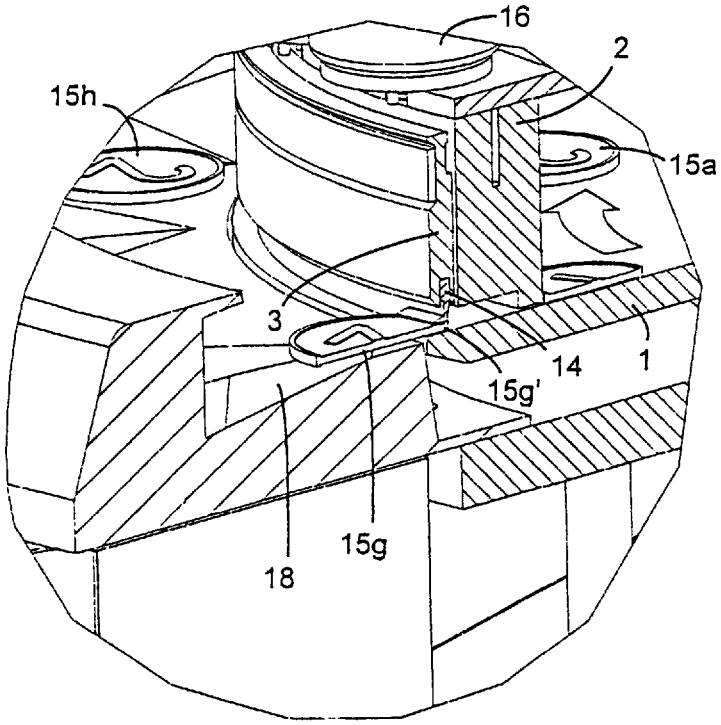
FIG. 4 is an enlarged view of a portion of FIG. 3.
Figure 5:
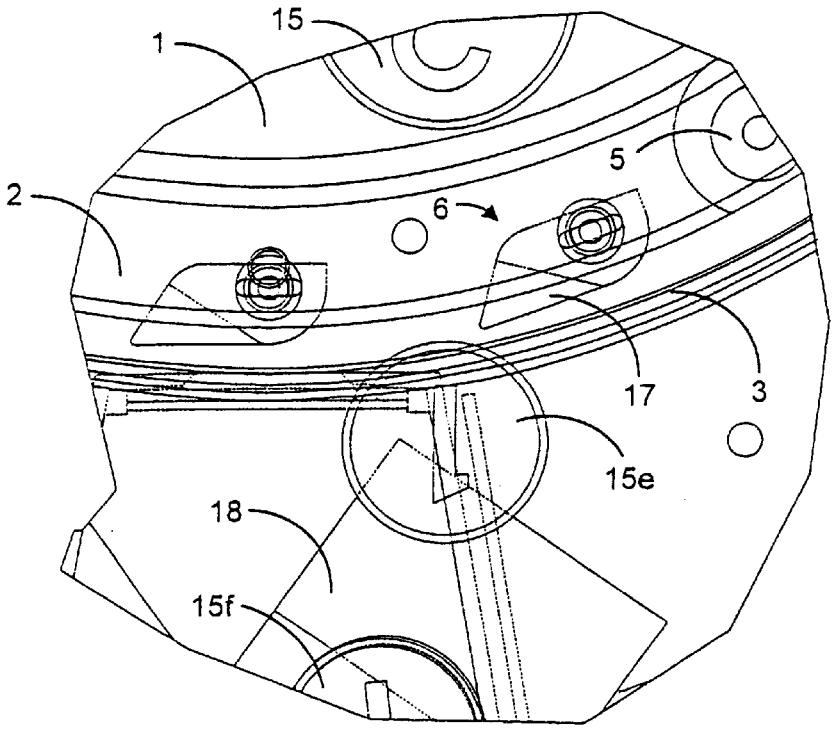
FIG. 5 is a detailed plan view illustrating an off-sort station with a coin deflector in a first, inactive position.
Figure 6:
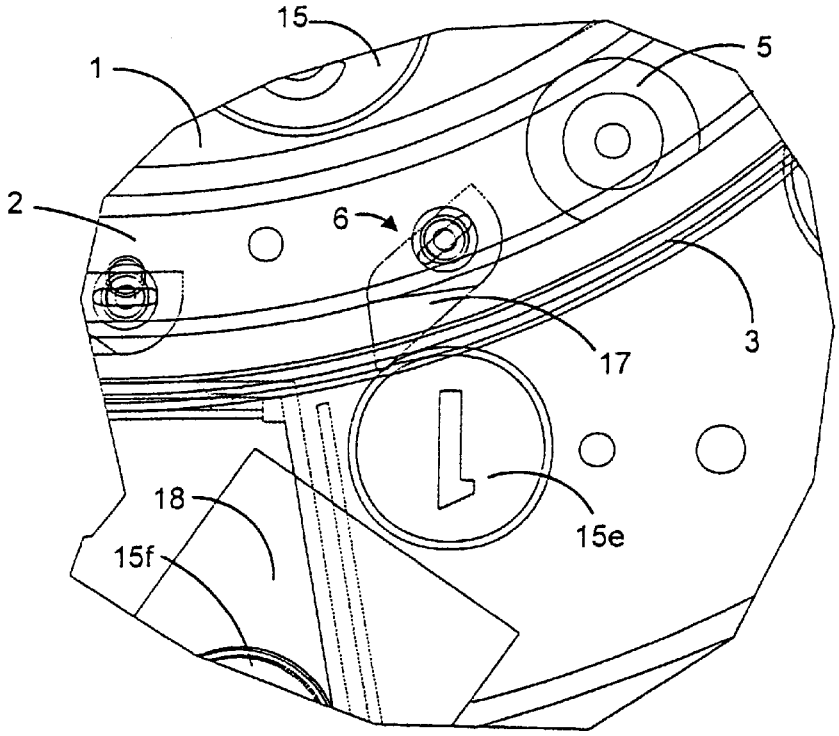
FIG. 6 is a view corresponding to FIG. 5 but with the coin deflector in a second, active position.

The thickness of the stationary edge 4 is chosen so that only a single-layer file of coins will be deviated therefrom. As a plurality of coins 15*b* are centrifugally forced towards the rotating ring 3 and approach the stationary edge 4 by the rotation of the disk 1, the lowest layer of coins will be deviated or peeled off by the stationary edge 4 to form a single file of coins 15*c*, which are engaged between the resilient rim 14 and the rotating disk 1. In other words the stationary edge 4 pushes the lowest layer of coins in a single file through the resilient rim 14 to the outside wall of the stationary ring 2, which forms a reference edge. The coins 15 are engaged at the periphery thereof between the resilient rim 14 and the rotating disk 1 and are accurately transported, essentially without friction or other energy losses, along a circular sorting path. FIG. 4 provides a detailed illustration of a coin 15*g*, which is engaged at a short portion 15*g′* thereof between the rim 14 and the disk 1. As appears from FIG. 2, the coin 15*g* has been carried approximately 180° around its circular path starting from the point of engagement at 15*c*. Coins of small diameter (as seen at 15*c* and 15*e*) as well as coins of a larger diameter (as seen at 15*d* and 15*g*) may be freely engaged and transported between the resilient rim 14 and the rotating disk 1 in the manner described above.

A coin sensor or discriminator 8 is arranged to detect the passage of a respective coin 15*d* and to identify the denomination or type thereof. The coin discriminator 8 may operate in a contactless manner known per se in the technical field, such as by inductive or optical means, as is readily realized by a man skilled in the art. Among many other publications, a suitable coin discriminator is described in e.g. WO87/07742.

The apparatus is provided with an encoder 24 for determining the rotational speed of the rotating disk 1 and the rotating ring 3. The encoder 24 as well as the coin discriminator 8 are operatively connected to a controller not disclosed herein. The controller is arranged to use information received from the encoder and the coin discriminator 8 to determine the position of each coin 15*d*, 15*e*, 15*g* relative to the coin discriminator 8 at different points in time. When the controller has determined that the coin has reached a correct off-sort station 6, the controller will activate a deflector unit 16, 17 located at each off-sort station. In FIG. 2 small coins (denomination "1") are sorted off at the first off-sort station (see coins 15*e* and 15*f*), while large coins (denomination "2") are handled by the last off-sort station (see coin 15*h*).

Figure 2:
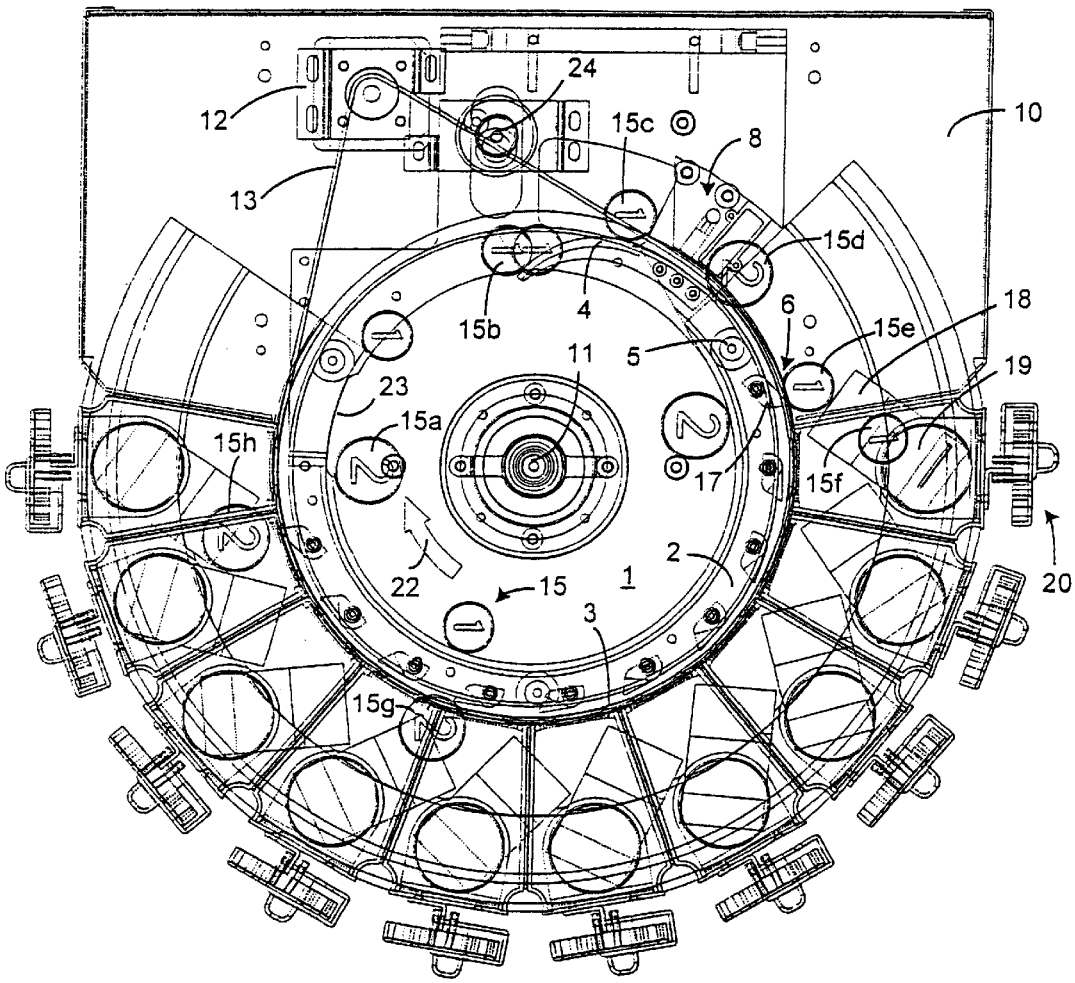
FIG. 2 is a plan view of the coin handling apparatus of FIG. 1.
Figure 3:
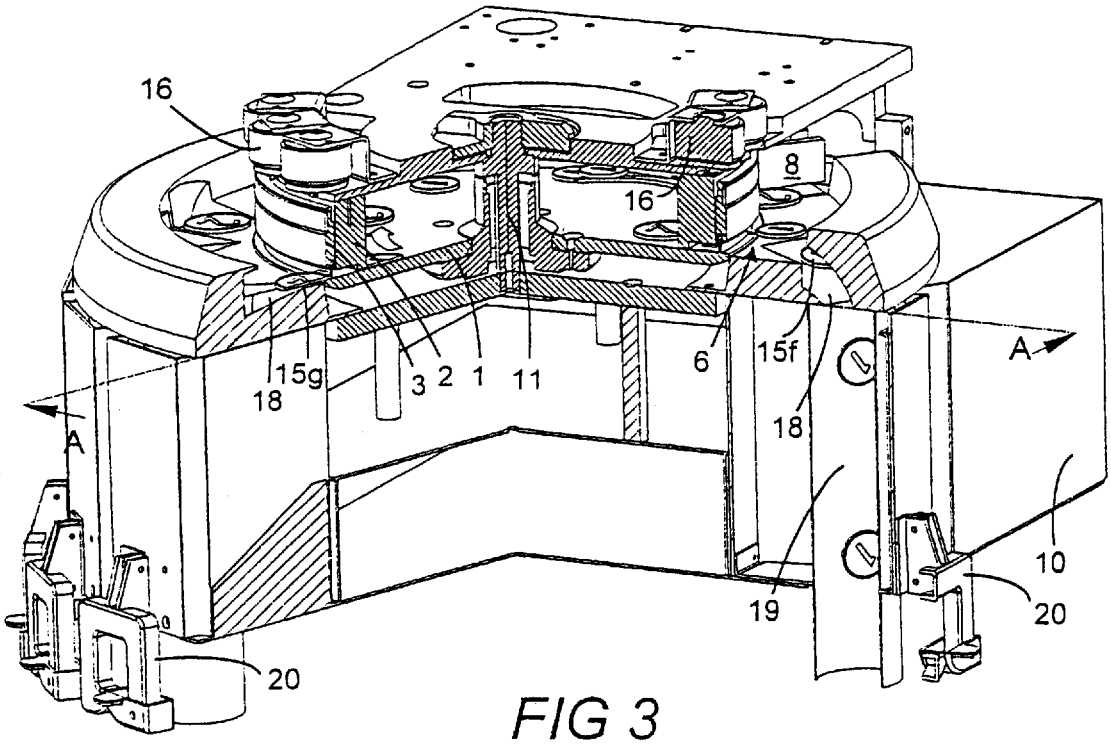
FIG. 3 is a perspective sectional view of the apparatus of FIGS. 1 and 2.

As seen in FIGS. 1 and 2, a total of ten off-sort stations 6, corresponding coin chutes 18, 19 and bag attachments 20 are arranged along a portion of the outer periphery of the rotating disk 1 and the rotating ring 3. The deflector unit 16, 17 at each off-sort station 6 comprises a rotary solenoid 16 and a pivotal mechanical deflector 17. The solenoid 16 is connected to the deflector 17 and is arranged to move the deflector 17, when actuated by the controller, from a first, inactive position according to FIG. 5 to a second, active position according to FIG. 6. In the inactive position of the deflector 17, the coins transported along the sorting path between the rotating disk 1 and the rotating ring 3 are allowed to pass the deflector, whereas in the active position of the deflector 17, a passing coin 15*e* will be deflected from the sorting path and delivered into the respective coin chute 18, 19.

Hence, the deflector 17 is arranged to push the respective coin through the resilient rim 14 and the rotating disk 1, so that the coin is released from the engagement between the rim 14 and the disk 1. When a coin 15*f* has been released, it will fall into a respective coin chute 18, 19. As best shown in FIG. 3, each coin chute comprises an upper portion 18 and a lower portion 19. The upper portion 18 has a downward slope, while the lower portion 19 runs essentially vertically. After having passed through the coin chute 18, 19, the coin 15*f* is deposited into a respective coin bag (not shown), which is mounted on a respective coin bag attachment 20.

Preferably, one of the off-sort stations 6 has a special reject function for rejecting coins, which have been found by the coin discriminator 8 and the controller to be of invalid denomination type.

Figure 7:
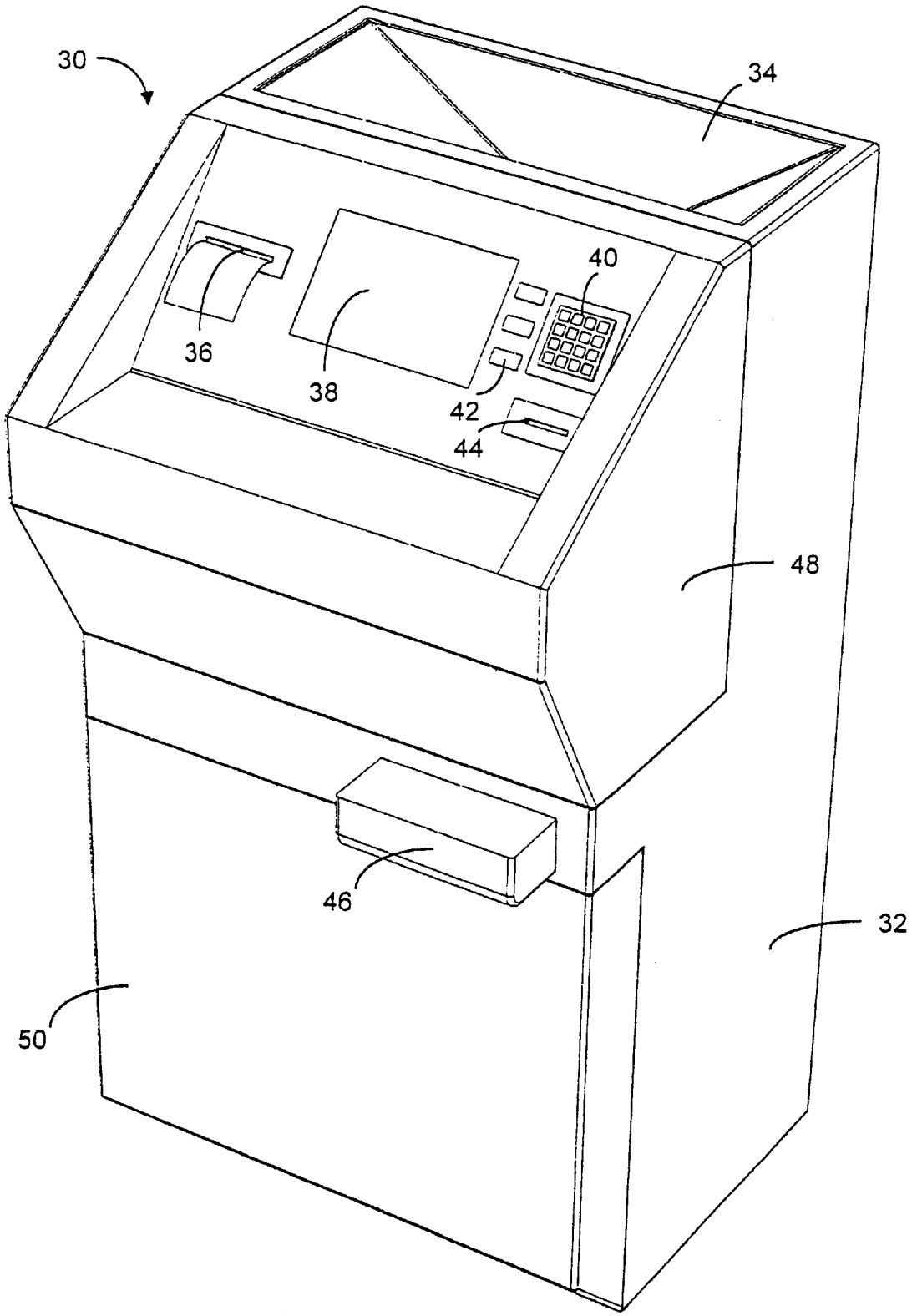
FIGS. 7 and 8 are perspective views of a coin deposit machine, in which a coin handling apparatus according to the invention is incorporated.
Figure 8:
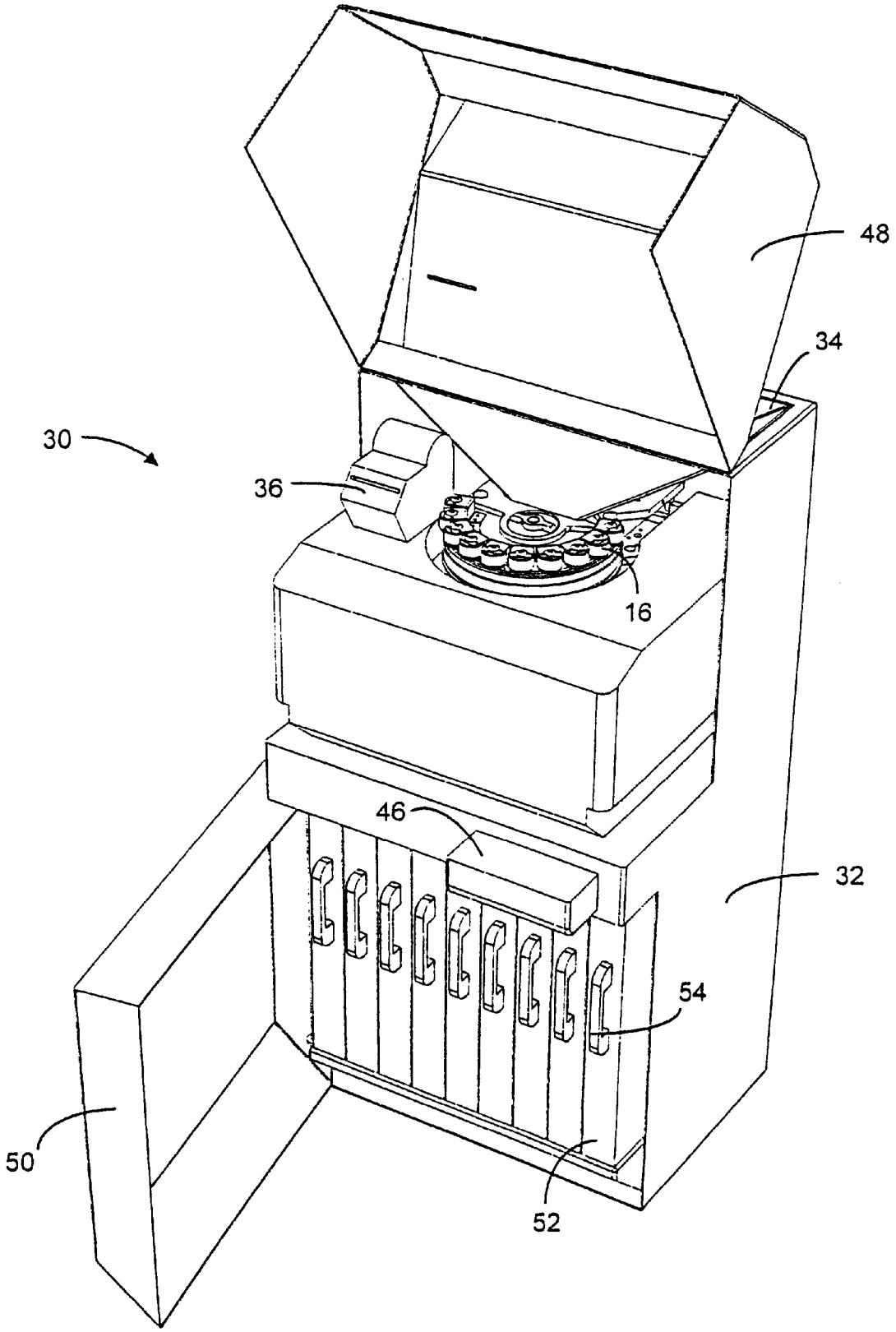

According to an alternative embodiment, the coin handling apparatus shown in FIGS. 2–6 is incorporated in a coin deposit machine of the type shown in FIGS. 7 and 8. Such coin deposit machines are generally used on a self-service basis by an untrained user (e.g. a shop visitor, a bank customer, etc.), who may deposit a plurality of coins of mixed denominations, for instance originating from his pocket, wallet or savings-box. The coins are put by the user into a coin intake in the machine, and then the user initiates the coin processing by pressing a start button or the like. The coin deposit machine is arranged to count and/or sort the coins deposited by the user and provide a receipt or voucher in return. The receipt or voucher may be used as payment for articles offered in a shop. Alternatively, a bank account belonging to the user may be credited an amount corresponding to the total value of the coins. Coin deposit machines are known per se e.g. from WO94/06101 and have been used by the applicant and others at least since the 1980's.

As shown in FIGS. 7 and 8, the cash deposit machine 30 comprises a cabinet 32 having a coin intake or opening 34 in the upper portion thereof for receiving said plurality of coins from the user. The cabinet 32 has an upper cover 48, which, according to FIG. 8, may be swung open by e.g. service personnel. Furthermore, the cabinet 32 has a lower door 50, which also may be swung open e.g. for emptying any of a plurality of coin receptacles 52.

Furthermore, the machine 30 comprises a receipt printer 36, a monitor 38, a key pad 40, additional keys 42 and a card slot 44. As shown in FIG. 8, a coin handling apparatus according to the invention is incorporated in the interior of the machine behind the cover 48.

Once the user has deposited some coins in the coin intake 34, the counting and/or sorting process is initiated. The process may be initiated by pressing any of the keys 40 or 42, or, alternatively, the process may be automatically initiated by a detector in the coin intake 34. The coins are supplied to the upper surface of the rotating disk 1, as described above. The coins are then sequentially transported by the rotating ring 3 and the rotating disk 1 around the circular sorting path. The coins are deflected at any of the off-sort stations 6 and fall into respective coin chutes 18, 19. In contrast to the stand-alone coin handling machine shown in FIG. 1, the coin deposit machine 30 does not use any coin bag attachments. Instead, the coin chutes end at respective coin receptacles 52, which are arranged side by side at a lower portion of the machine 30, as shown in FIG. 8. Each coin receptacle is provided with a handle 54 and may easily be removed from the machine 30 by authorized personnel. Furthermore, the coin receptacles 52 may be placed upon a removable trolley (not shown) to facilitate removal of all coin receptacles 52 simultaneously.

As the coins are processed by the coin handling apparatus, a value representing a total amount of the coins is calculated by the controller of the coin handling apparatus or by separate controller means, such as a computer or CPU with associated memory. Coins, that are rejected by the coin handling apparatus, are returned in a reject tray 46, which is accessible to the user. When all coins have been processed by the coin handling apparatus, a voucher or receipt is provided by the printer 36. A total value, as calculated by the machine 30, is printed on the receipt 36, as described above. During all times, the monitor 38 may be used for user interaction, e.g. for presenting guidance or informative messages to the user. The user may insert a credit card, a smart card or any other care-shaped information carrier through the card slot 44. A card reader inside the machine 30 is arranged to read information stored on the card and to act accordingly. For instance, the card may contain information regarding a bank account number to credited, once the total amount of the coins has been determined.

The disclosure above of the coin handling apparatus and the coin deposit machine according to the preferred and alternative embodiments of the invention are to be taken as examples only. The invention may be carried out in other ways than the ones described above within the scope of the inventive concept, as defined by the appended independent patent claims.

I claim:

1. A coin handling apparatus for at least one of sorting and counting a plurality of coins, said apparatus comprising a circular sorting path with at least one off-sort station and a rotatable carrier device for carrying such coins along a circular sorting path, characterized by a first rotatable means with a first surface and a second rotatable means with a second surface, said first and said second surfaces being arranged to rotate at essentially a same speed and being arranged to engage such coins therebetween, thereby transporting such coins along said circular sorting path.

2. A coin handling apparatus according to claim 1, wherein said first rotatable means is a rotating disc, to which such plurality of coins are deposited prior to a handling thereof.

3. A coin handling apparatus according to claim 1, wherein said second rotatable means is provided with resilient means for frictional engagement with said first surface of said first rotatable means and with such coins.

4. A coin handling apparatus according to claim 3, wherein said resilient means is one of an elastomer strip and a rim.

5. A coin handling apparatus according to claim 1, further comprising electrically operated deflector means at each off-sort station.

6. A coin handling apparatus according to claim 2, further comprising electrically operated deflector means at each off-sort station.

7. A coin handling apparatus according to claim 3, further comprising electrically operated deflector means at each off-sort station.

8. A coin handling apparatus according to claim 5, wherein said deflector means comprises a rotary solenoid.

9. A coin handling apparatus according to claim 7, wherein said deflector means comprises a rotary solenoid.

10. A coin handling apparatus according to claim 6, wherein said deflector means comprises a pivotal member for releasing a coin from an engagement between said first and said second surfaces.

11. A coin handling apparatus according to claim 8, wherein said deflector means comprises a pivotal member for releasing a coin from an engagement between said first and said second surfaces.

12. A coin handling apparatus according to claim 6, further comprising at least one of a coin sensor and discriminator for identifying at least one of a denomination and type of such coins.

13. A coin handling apparatus according to claim 3, further comprising at least one of a coin sensor and discriminator for identifying at least one of a denomination and type of such coins.

14. A coin handling apparatus according to claim 5, further comprising at least one of a coin sensor and discriminator for identifying at least one of a denomination and type of such coins.

15. A coin handling apparatus according to claim 8, further comprising at least one of a coin sensor and discriminator for identifying at least one of a denomination and type of such coins.

16. A coin handling apparatus according to claim 10, further comprising at least one of a coin sensor and discriminator for identifying at least one of a denomination and type of such coins.

17. A coin handling apparatus according to claim 12, wherein said deflector means further comprises a controller operatively connected to said deflector means and said coin sensor for selectively actuating said deflector means at a particular off-sort station in response to at least one of a denomination and type of such coin as identified by said at least one of a coin sensor and discriminator.

18. A coin handling apparatus according to claim 14, wherein said deflector means further comprises a controller operatively connected to said deflector means and said coin sensor for selectively actuating said deflector means at a particular off-sort station in response to at least one of a denomination and type of such coin as identified by said at least one of a coin sensor and discriminator.

19. A coin handling apparatus according to claim 16, wherein said deflector means further comprises a controller operatively connected to said deflector means and said coin sensor for selectively actuating said deflector means at a particular off-sort station in response to at least one of a denomination and type of such coin as identified by said at least one of a coin sensor and discriminator.

20. A coin handling apparatus according to claim 1, further comprising coin receptacle means located at each said off-sort station for storing coins received at said at least one off-sort station.

21. A coin handling apparatus according to claim 5, further comprising coin receptacle means located at each said off-sort station for storing coins received at said at least one off-sort station.

22. A coin handling apparatus according to claim 8, further comprising coin receptacle means located at each said off-sort station for storing coins received at said at least one off-sort station.

23. A coin handling apparatus according to claim 10, further comprising coin receptacle means located at each said off-sort station for storing coins received at said at least one off-sort station.

24. A coin handling apparatus according to claim 12, further comprising coin receptacle means located at each said off-sort station for storing coins received at said at least one off-sort station.

25. A coin handling apparatus according to claim 17, further comprising coin receptacle means located at each said off-sort station for storing coins received at said at least one off-sort station.

26. A coin handling apparatus according to claim 1, wherein said first and said second rotatable means are arranged to rotate essentially horizontally.

27. A coin handling apparatus according to claim 5, wherein said first and said second rotatable means are arranged to rotate essentially horizontally.

28. A coin handling apparatus according to claim 8, wherein said first and said second rotatable means are arranged to rotate essentially horizontally.

29. A coin handling apparatus according to claim 10, wherein said first and said second rotatable means are arranged to rotate essentially horizontally.

30. A coin handling apparatus according to claim 12, wherein said first and said second rotatable means are arranged to rotate essentially horizontally.

31. A coin handling apparatus according to claim 17, wherein said first and said second rotatable means are arranged to rotate essentially horizontally.

32. A coin handling apparatus according to claim 20, wherein said first and said second rotatable means are arranged to rotate essentially horizontally.

33. A coin deposit machine having a cabinet, an opening for receiving a plurality of coins from a user, means for at least one of counting and sorting such plurality of coins, means for determining a value related to such plurality of coins and means for indicating such value to such user, characterized in that said means for one of counting and sorting includes a coin handling apparatus.

* * * * *